US005251564A

United States Patent [19]

Rim et al.

[11] Patent Number: 5,251,564

[45] Date of Patent: * Oct. 12, 1993

[54] COMBUSTION BOX EXHAUST FILTRATION SYSTEM AND METHOD

[76] Inventors: Julius J. Rim, 2743 Bloomfield Crossing, Bloomfield Hills, Mich. 48304; Ho Rim, 601-4 Sinsa-Dong, Kangnam-Ku, Seoul, Rep. of Korea

[ * ] Notice: The portion of the term of this patent subsequent to Feb. 4, 2009 has been disclaimed.

[21] Appl. No.: 797,701

[22] Filed: Nov. 25, 1991

Related U.S. Application Data

[63] Continuation-in-part of Ser. No. 549,738, Jul. 9, 1990, Pat. No. 5,085,049.

[30] Foreign Application Priority Data

Apr. 26, 1990 [KR] Rep. of Korea ..... 90-5855

[51] Int. Cl.[5] ..... F23J 3/00

[52] U.S. Cl. ..... 110/344; 60/279; 110/345; 110/216

[58] Field of Search ..... 60/274, 278, 279, 288, 60/289, 295; 55/466, DIG. 30; 110/344, 345, 216

[56] References Cited

U.S. PATENT DOCUMENTS

| | | | |
|---|---|---|---|
| 4,281,512 | 8/1981 | Mills | 60/311 |
| 4,319,453 | 3/1982 | Mann | 60/311 |
| 4,518,395 | 5/1985 | Petronella . | |
| 4,576,617 | 3/1986 | Reneuot . | |
| 4,631,076 | 12/1986 | Kurihara et al. . | |
| 4,685,291 | 8/1987 | Ha . | |
| 4,720,972 | 1/1988 | Rao et al. . | |
| 4,730,454 | 3/1988 | Pischinger et al. . | |
| 4,813,233 | 3/1989 | Vergeer et al. . | |
| 4,864,821 | 9/1989 | Hoch | 60/279 |
| 4,923,484 | 5/1990 | Saito | 55/DIG. 30 |
| 5,085,049 | 2/1992 | Rim et al. | 60/279 |

FOREIGN PATENT DOCUMENTS

| | | | |
|---|---|---|---|
| 214 | 10/1986 | Rep. of Korea . | |
| 244 | 3/1987 | Rep. of Korea . | |
| 2097283 | 11/1982 | United Kingdom | 60/279 |

OTHER PUBLICATIONS

Exhaust-Pollution Control Developments, Research and Development, 2 pages, dated before Jun., 1990.

Letter of Oct. 19, 1990 from St. of California, Air Resources Board.

*Primary Examiner*—Henry C. Yuen

*Attorney, Agent, or Firm*—Peter D. Keefe

[57] ABSTRACT

A combustion box exhaust filtration system and method which removes both particulate matter (PM) and unburned hydrocarbons (UHC) from the exhaust gases. Two filters in parallel are used, each alternating operation as the other regenerates. Each filter is preferred to be constructed in a conventional manner and operates at between 100 to 300 degrees Centigrade. A microprocessor controlled valve system regulates which filter is active and which is regenerating and/or inactive. PM accumulates at the active filter, with UHC condensing on the PM. Accordingly, only PM and UHC free gasses pass out the exhaust. When the active filter becomes clogged, the microprocessor switches it to inactive status, and switches the other filter to active status. Regeneration of the inactive filter is initiated by the microprocessor using a glow plug at a predetermined location in the filter, in which PM and UHC burn slowly across the entire filter. A recirculation conduit provides for the gases produced by the resulting slow regeneration to be directed to the air intake of the combustion box. Any remaining UHC or PM will be subsequently burned in the combustion box. When regeneration has completed, the inactive filter will await being switched by the microprocessor to active status when the other filter has become sufficiently clogged that it is time for the microprocessor to switch it inactive and thereafter initiate its regeneration.

15 Claims, 3 Drawing Sheets

COMBUSTION BOX EXHAUST FILTRATION SYSTEM AND METHOD

CROSS-REFERENCE TO RELATED APPLICATIONS

The present application is a continuation-in-part application of Ser. No. 07/549,738, filed on Jul. 9, 1990, which is U.S. Pat. No. 5,085,049.

BACKGROUND OF THE INVENTION

1. Field of the Invention

The present invention relates to combustion exhaust filter traps, such as those f or Diesel particulate matter. More particularly the present invention relates to to an improved system and method therefor for removing particulate matter (PM) and unburned hydrocarbons (UHC) from the exhaust of combustion boxes, such as a municipal garbage incinerator. Still more particularly, the present invention relates to a combustion box exhaust filtration system and method which utilizes dual PM/UHC traps, low temperature regeneration ignition of the PM and associated UHC to burn the PM and UHC into CO and $CO_2$ gases and recirculation of the burned PM and UHC back into the combustion box air intake for subsequent burning of any remaining UHC in the combustion box.

2. Description of the Prior Art

Increasingly garbage disposal has become an increasingly more difficult as land fills become ever more costly and unavailable. Accordingly, municipalities have turned to incineration to get rid of burnable garbage and produce electricity at the same time. Attendantly, environmental awareness has increasingly focused on limiting or eliminating offensive stack emissions from incinerators and other types of facilities and devices in which combustion occurs, hereinafter referred to inclusively as "combustion boxes". It is a well recognized problem that combustion produces a particulate matter soot, hereinafter referred to as "PM". PM is offensive to the average person, but actually, PM is composed mainly of carbon which, though not harmless, is less hazardous than unseen unburned hydrocarbons, hereinafter ref erred to as "UHC", which are known to be carcinogens. Thus, f or both the sake of the environment and the health of the public it is very desirable to reduce or eliminate both PM and UHC from the exhaust of combustion boxes.

An area of technology in which combustion box exhaust filtration has been studied extensively pertains to exhaust of Diesel engines. In the devices proposed in the prior art, there is provided a PM trap consisting in one form or another of a perforated metallic tube covered by a ceramic fiber filter. The metallic tube provides mechanical strength, while the ceramic fiber filter performs the actual PM removal. As engine operation proceeds, the PM trap accumulates progressively more PM. Problematically, the PM eventually clogs the PM trap resulting in loss of engine performance and, if left to continue unabated, would cause the engine to stall. Accordingly, there is provided some means for periodically removing the accumulated PM from the PM trap. This process of PM removal is referred to as "regeneration". Regeneration is typically accomplished by burning the PM at or above its ignition temperature of around 600 degrees Centigrade (in the presence of oxygen), which converts the PM into CO and $CO_2$. During regeneration, the Diesel exhaust may dump to the atmosphere, or a second PM trap may be utilized in a cyclic fashion of operation. It will be appreciated in view of the foregoing, that a ceramic fiber filter is preferred as it can withstand the temperatures associated with regeneration, yet can trap PM which typically are on the order of 0.1 to 0.3 micrometers in size.

Two different approaches have been taken to accomplish periodic regeneration of PM traps. The first is to operate the PM Trap as close as possible to the PM ignition temperature, the second is to operate the PM trap at lower than the PM ignition temperature.

The theory behind operating a PM trap near the ignition temperature of PM is to permit rapid regeneration with very little additional energy being needed to provide ignition. The operating temperature of the PM trap is maintained high by locating it near the exhaust manifold, and either fuel or electricity is introduced to initiate ignition of the PM. In some systems, the Diesel engine RPM is increased so as to provide a suitably hot exhaust gas for ignition of the PM. Operation of the PM trap near the PM ignition temperature, while providing suitable burning of the PM, results in a very rapid burn process. This frequently leads to PM trap failure due to thermal shock, shortened life, melt-down, or poor operation under certain driving modes.

The theory behind operating a PM trap below the ignition temperature of the PM is to provide regeneration which is less injurious to the PM trap. In order to achieve ignition of the PM at a temperature below 600 degrees Centigrade, a PM oxidation promoting catalyst is introduced into the fuel, added as an exhaust gas chemical agent upstream of the PM filter, or as a pretreat for the ceramic fiber filter of the PM trap. These catalysts are certain metallic compounds, most notably composed of lead, copper, manganese, or noble metals, such as platinum and palladium.

Specific examples of the prior art will now be given.

U.S. Pat. No. 4,576,617 to Renevot, dated Mar. 18, 1986, discloses a Diesel exhaust PM trap which utilizes a regeneration process in which a very flammable mixture, such as methyl alcohol, is introduced into the PM trap which, in combination with a glow plug, effects ignition of the PM. Different mixtures may be used depending on whether the filter of the PM trap is impregnated with a catalyst, such as either platinum or palladium, as the ignition temperature of the PM will be different in accordance therewith.

U.S. Pat. No. 4,631,076 to Kurihara et al, dated Dec. 23, 1986, discloses a PM trap which utilizes regeneration based upon ignition of the PM caused by selective introduction of catalytic solutions into the exhaust gas upstream of the PM trap. Examples of suitable metal catalytic compounds include $Pd(NH_4)_3(OH)_2$ and $Cu(NH_3)_4(OH)_2$.

U.S. Pat. No. 4,685,291 to Ha, dated Aug. 11, 1987, and U.S. Pat. No. 4,813,233 to Vergeer et al, dated Mar. 21, 1989, disclose a dual PM trap system in which periodic regeneration may be achieved at lower than 600 degrees centigrade, where a by-pass conduit allows selectively for heated or cool-ed exhaust gasses to enter the PM traps. Four different ways to achieve regeneration are disclosed, as follows. 1) Each of the PM traps are located remote from the engine, but each is selectively heated by the other's exhaust manifold. When not heated, UHC can accumulate on the pores of the trapped PM. To effect regeneration, heat from the other PM trap's exhaust manifold is used to induce ignition of the PM, where it is believed by the inventor that the UHC serves as a fuel to assist ignition of the PM at temperatures as low as 250 degrees Centigrade. Exhaust coolers may be used in place of remote placement of the PM traps. 2) For two-stroke Diesel engines, regeneration is induced by a synergism between the scavenging blower system and introduction of finely atomized fuel above the PM traps, with a diesel fuel additive being used, such as manganese in concentrations on the order of 100 mg/L of diesel fuel. 3) Regeneration is induced by introduction of finely atomized fuel combined with air above the PM traps, with a diesel fuel additive being used, such as manganese in concentrations on the order of 80 to 100 mg/L of diesel fuel, or copper. 4) Again, for two-stroke Diesel engines, regeneration is induced by a scavenging blower system which controls the scavenging ratio of the engine, and introduction of finely atomized fuel above the PM traps, regeneration occurring because of increased exhaust gas temperature at medium load speed conditions, a diesel fuel additive being used, such as manganese in concentrations on the order of 100 mg/L of diesel fuel.

U.S. Pat. No. 4,720,972 to Rao et al, dated Jan. 26, 1988, discloses a dual PM trap utilizing a heat exchanger to cool the exhaust gases to the range between 200 and 500 degrees Fahrenheit, which promotes condensation of UHC upon the PM at the PM trap. The PM trap uses a catalytically coated ceramic fiber or wire mesh, where the catalytic material may comprise $SO_2$ active oxidation catalyst such as platinum, tungsten or paladium-platinum coated on a porous, cellular cordierite body. Electrical heating is used to initiate ignition, and a burn front will progressively move down the PM trap from the ignition location until regeneration concludes in 6 to 9 minutes.

U.S. Pat. 4,730,454 to Pischinger et al, dated Mar. 15, 1988, discloses a PM trap in which regeneration is effected by regulating the PM concentration which lies within the explosive range of the PM/exhaust mixture by briefly adding or recycling combustible particulates to the exhaust gas flow at the PM trap. A secondary source of energy, such as electrical, is used to supply ignition, from which an explosive wave runs progressively through the PM trap.

While the schemes for cleaning Diesel exhaust are effective to remove PM, there is presently no successful system which can effectively remove both PM and UHC from Diesel exhaust.

SUMMARY OF THE INVENTION

The present invention is a combustion box exhaust filtration system and method which removes both PM and UHC from the exhaust gases.

According generally to the apparatus and method of the present invention, two filters are used, each alternating operation as the other regenerates. Each filter is preferred to be constructed in a conventional manner utilizing a perforated tube covered by a ceramic fiber filter media. Each fitter is located sufficiently far from the combustion box, or a heat exchanger is located upstream of the filters, so that the exhaust gases at the filters is approximately between 100 to 300 degrees Centigrade. A microprocessor controlled valve system regulates which filter is active and which is regenerating and/or inactive. PM accumulates at the active filter, and because of the low ambient temperature, UHC easily condense on the large surface area provided by the PM and thus also filter out of the exhaust gases. Accordingly, only PM and UHC free gasses pass out the exhaust. When the active filter becomes clogged, the microprocessor switches it to inactive status, and switches the other filter to active status. Regeneration of the inactive filter is initiated by the microprocessor using a glow plug at a predetermined location in the filter, in which PM and UHC burn slowly across the entire filter. A recirculation conduit provides for the gases produced by the resulting slow regeneration to be directed to the air intake of the combustion box. Any remaining UHC or PM will be subsequently burned in the combustion box. When regeneration has completed, the inactive filter will await being switched by the microprocessor to active status when the other filter has become sufficiently clogged that it is time for the microprocessor to switch it inactive and thereafter initiate its regeneration.

Accordingly, it is an object of the present invention to provide a combustion box exhaust filtration system and method which removes not only PM but also UHC from the exhaust.

It is a further object of the present invention to provide a combustion box exhaust filtration system which provides for continuous filtration even during periodic regeneration episodes.

It is an additional object of the present invention to provide a combustion box exhaust filtration system which provides for filtration of exhaust gases at very low temperature, on the order of 100 to 300 degrees Celsius, thereby m g removal of UHC on the surface of the accumulated PM.

It is another object of the present invention to provide a combustion box exhaust filtration system which provides for slow regeneration on the order of ten to twenty minutes or longer.

It is yet another object of the present invention to provide a combustion box exhaust filtration system which provides for slow regeneration on the order of ten to twenty minutes or longer, in which the gases released during regeneration are directed to the other active filter for filtering out any yet remaining PM and UHC, thereby providing essentially no PM or UHC will exit to the atmosphere.

It is still another object of the present invention to provide a combustion box exhaust filtration system which provides for slow regeneration on the order of ten to twenty minutes or longer, in which the gases released during regeneration are directed back into the combustion box air intake, thereby providing final burning of all released UHC vapor and any remaining PM.

It is yet an additional object of the present invention to provide a combustion box exhaust filtration system which provides for slow regeneration on the order of ten to twenty minutes or longer, in which atmospheric air is introduced into the filter undergoing regeneration so as to facilitate the oxidation process.

It is yet a further object of the present invention to provide a dual filter combustion box exhaust filtration system equipped with a microprocessor controlled valve system which regulates automatically which filter is active, which filter is inactive and/or regenerating, introduction of atmospheric air into the regenerating filter and selective routing of exhaust into and out of the filters, inclusive of routing of gases released during regeneration back to the combustion box air intake.

It is still an additional object of the present invention to provide a combustion box exhaust filtration system which uses a metallic compound of copper based fuel catalyst for promoting regeneration at relatively low temperature, a stabilizer being added to the fuel comprising ethyl or methyl alcohol in the amount of 3 to 10 percent by volume.

These, and additional objects, advantages, features and benefits of the present invention will become apparent from the following specification.

DETAILED DESCRIPTION OF THE PREFERRED EMBODIMENT

Figure 1:
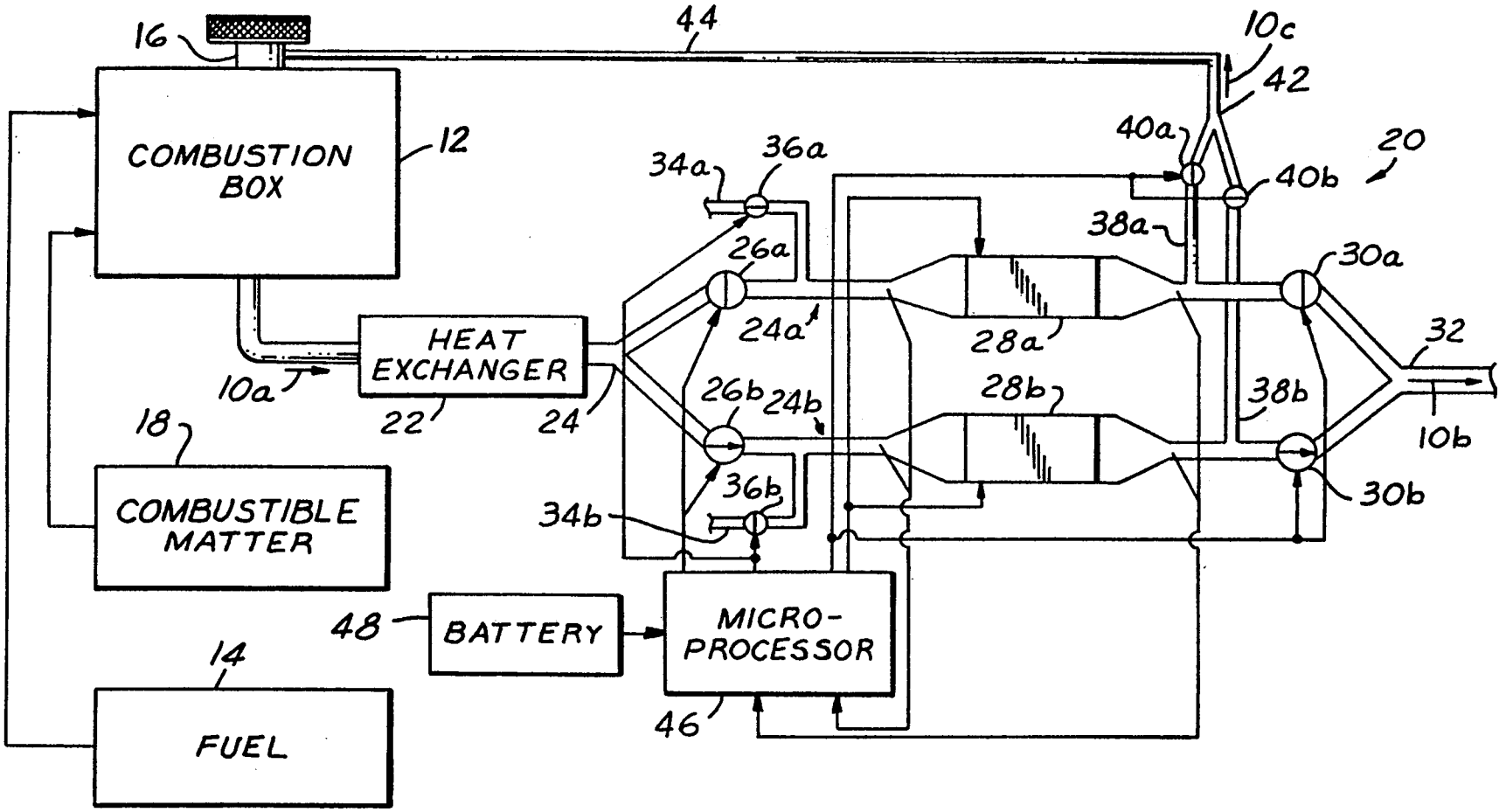
FIG. 1 is a schematic depiction of the combustion box exhaust filtration system according to the present invention, the depiction being that of an incinerator facility.

Referring now to the Drawing, FIG. 1 shows generally the combustion box exhaust filtration system according to the apparatus and method of the present invention in operation with respect to, as an example, an incineration facility. The combustion box 12 provides an enclosed space for incineration of combustible matter 18 to take place. Fuel 14 is utilized in the combustion box to initiate and sustain burning of the combustible matter 18. Briefly stated in terms of an overview, the combustion box exhaust filtration system according to the present invention operates on the basis of selecting one filter for filtering while a second filter connected in parallel with the first filter is being regenerated. During regeneration, air from the atmosphere is admitted to ensure optimum oxidation, while the by-products of regeneration are directed back to the combustion box at its air intake for final and complete burning therein of any remaining PM or UHC, and subsequent refiltering through the other active filter. Thus, at all times only filtered exhaust reaches the atmosphere.

The apparatus for carrying-out the preferred embodiment of the present invention is as follows.

The combustion box 12, which constitutes any enclosed place where combustion takes place, operates conventionally, utilizing fuel 14, which may or may not be treated with a catalyst, and utilizing air through its air intake 16. Additional combustible matter 18, such as garbage, may or may not enter into the combustion box 12 for incineration. The combustion by-products in the form of various unfiltered exhaust gases 10*a*, including particulate matter (PM) and unburned hydrocarbons (UHC), exit the combustion box 12 and enter an exhaust filtration system 20, the exhaust filtration system has the following components.

A heat exchanger 22 is located downstream of the combustion box 12 and is used for cooling the exhaust gases 10*a* as they firstly enter the exhaust filtration system 20. Downstream of the heat exchanger 22 is a first Y-shaped branching pipe 24 which defines a first and second branch 24*a* and 24*b*, respectively. Downstream of the first Y-shaped branching pipe 24 is a first shut-off valve 26*a* and 26*b* respectively at each branch 24*a* and 24*b* for selectively shutting off exhaust gas flow along that respective branch. Downstream of each respective first shut-off valve is located a filter 28*a* and 28*b* interconnected with each branch 24*a* and 24*b*, respectively. Downstream of each filter 28*a* and 28*b* is located a second shut-off valve 30*a* and 30*b* interconnected with each branch 24*a* and 24*b*, respectively. Downstream of each second shut-off valve 30*a* and 30*b* is located a second Y-shaped branching pipe 32 interconnected with each branch 24*a* and 24*b*, from which filtered exhaust gases 10*b* exit to the atmosphere. Further, located between the first valves 26*a* and 26*b* and the filters 28*a* and 28*b* of each respective branch 24*a* and 24*b*, are air inlets 34*a* and 34*b* respectively for each branch 24*a* and 24*b*; each air inlet being controlled by respective inlet valves 36*a* and 36*b* for admitting air during regeneration of a respective filter. Still further, located between the filter 28*a* and 28*b* and the second shut-off valves 30*a* and 30*b* of each respective branch 24*a* and 24*b*, are exhaust recirculation conduits 38*a* and 38*b* for each branch 24*a* and 24*b*; each exhaust recirculation conduit being controlled by respective conduit valves 40*a* and 40*b* of each respective branch 24*a* and 24*b*. An exhaust recirculation conduit 44 connects at one end to the combustion box air intake 16, and at the other end to a Y-shaped conduit 42 which in turn connects with the conduit valves 40*a* and 40*b*. Operation of the above enumerated valves and filters is controlled by a microprocessor 46 which is powered by a source of electrical energy 48, and which electrically senses the condition of the filters 28*a* and 28*b* and electrically operates the valves and the filtering and regeneration operations of the filters.

The heat exchanger 22 provides for reduction in combustion box gases 10*a* temperature so that at the filters 28*a* and 28*b*, the temperature is in the area of between 100 and 300 degrees Centigrade. This temperature range is preferred so that UHC will condense upon the surface of trapped PM at the active or filtering filter, which is filter 28*b* in FIG. 1 (while filter 28*a* is the inactive or regenerating filter). Alternatively, the heat exchanger may be obviated by placing the filters 28*a* and 28*b* remote from the combustion box 12.

It will be seen from FIG. 1, that the following processes are occurring. Hot combustion box exhaust gases 10*a* are cooled by passage through the heat exchanger 22. First shut-off valve 26*a* is closed, thereby closing off branch 24*a*, while first shut-off valve 26*b* is open, thereby permitting unfiltered exhaust gas 10*a* to pass to the active filter 28*b*. The unfiltered exhaust gas 10*a* is thereupon filtered at the active filter 28*b*, during which removal of PM and UHC takes place. Filtered exhaust gas 10*b* then leaves the active filter 28*b*, passes through open second shut-off valve 30*b* and passes finally out to the atmosphere. Meanwhile, inactive filter 28*a* is being regenerated. Ignition of the trapped PM and UHC in the inactive filter 28*a* is commenced by a glow plug igniter (not shown in FIG. 1) via operation of the microprocessor 46. The microprocessor 46 also regulates the opening of intake valve 36*a* so as to ensure complete oxidation in the inactive filter 28*a*. As oxidation proceeds over an extended time period on the order of 10 to 20 minutes, the released gases 10*c* are directed through open conduit valve 40*a* back to the air intake 16 of the combustion box 12, where combustion therein will burn any remaining uncombusted PM and UHC. Should, however, any PM and UHC yet remain, these will be trapped at the active filter 28b, so that in no event will PM and/or UHC reach the atmosphere.

Figure 2:
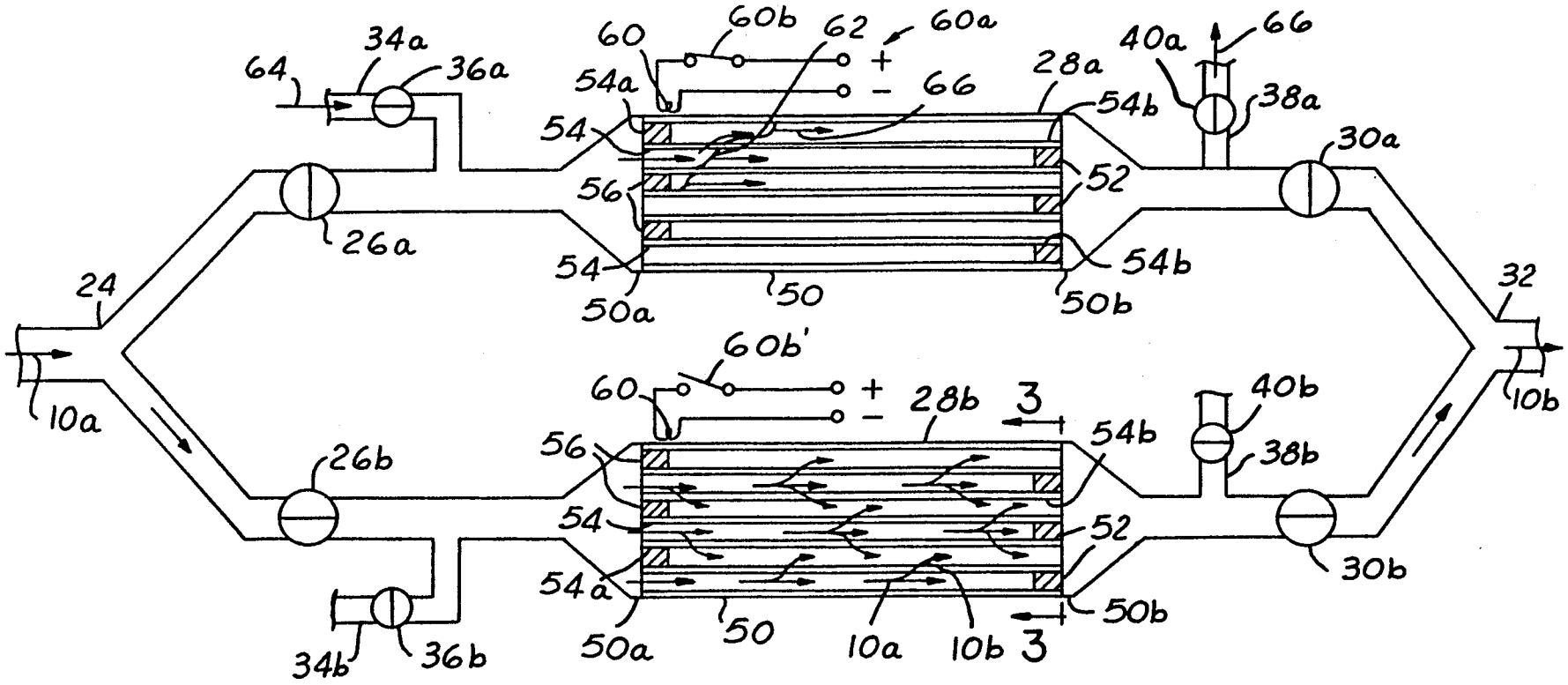
FIG. 2 is a part sectional plan view of the combustion box exhaust filtration system according to the present invention, showing in detail the exhaust path through the filters.
Figure 3:
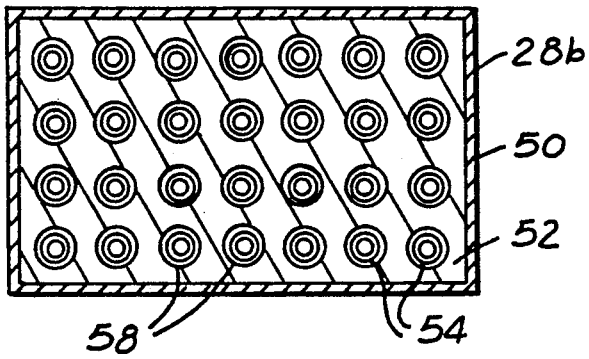
FIG. 3 is a sectional front view of one of the filters shown in FIG. 2, showing a plurality of internal filter components.
Figure 4:
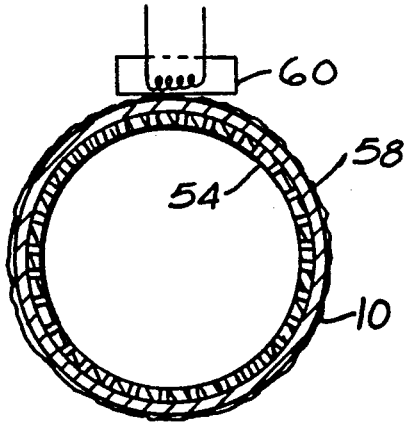
FIG. 4 is a detail part sectional front view of a filter component shown in FIG. 3, as well as an electronic regeneration igniter according to the present invention.

With reference now being made to FIGS. 2 through 4, a more detailed description of the filtration and regeneration apparatus and processes will be recounted, where FIG. 2 shows the exhaust filtration system 20 in the mode depicted in FIG. 1.

FIGS. 1 and 2 depict the exhaust filtration system 20 at a time when filter 28a has been rendered inactive because of an earlier active duty period in which it became clogged with PM and UHC. Thus, the microprocessor 46 sensed the back pressure caused by this clogging and has caused first shut-off valve 26b to be opened, then caused first shut-off valve 26a to be closed. The microprocessor 46 has also closed intake valve 36b, opened intake valve 36a, closed conduit valve 40b, opened conduit valve 40a, opened second shut-off valve 30b and closed second shut-off valve 30a. FIG. 2 depicts the exhaust filtration system 20 where filter 28a is now inactive with regeneration just underway, and where filter 28b is active and is presently filtering unfiltered exhaust gases 10a. It will be understood, therefore, that unfiltered exhaust gas 10a are filtered at active filter 28b, then the filtered exhaust gas 10b must pass the second shut-off valve 30b, then must exit to the atmosphere. It will be further understood that regeneration at inactive filter 28a is facilitated by air entry at air intake 34a, and released gases 10c by the regeneration oxidation process are vented through the conduits 38a, 42 and 44 and conduit valve 40a back to the air intake 16 of the combustion box 12.

Filtration at filter 28b of the unfiltered exhaust gas 10a and regeneration of filter 28a will now be more particularly detailed.

Both filters 28a and 28b are identical and constructed in a generally conventional manner as depicted with greater particularity in FIGS. 2 through 4. The filters 28a and 28b are preferably constructed as follows. An airtight casing 50 is provided which is closed at its downstream end 50b by a wall 52. A plurality of perforated pipes 54 are connected with the wall 52 at the downstream end 54b thereof, and communicate with respective second shut-off valves 30a, 30b. The upstream end 54a of the perforated pipes 54 are plugged by plugs 56 located adjacent the upstream end of the airtight casing 50. The perforated piping is covered by a ceramic fiber filter media 58 which is chosen to both withstand operational temperatures of the filter during filtration and regeneration, as well as filter out PM of a pre-selected cross-sectional size. A glow plug 60 is provided adjacent the ceramic fiber filter media for commencing ignition of the accumulated PM and UHC when regeneration is desired. It is to be understood that the Drawing figures are merely schematic, and that an operational filter 28a, 28b would be optimized in terms of its structure and geometry so as to provide most efficacious filtration and regeneration.

Considering now the filtration operation at active filter 28b, the unfiltered exhaust gas 10a will pass through the ceramic fiber filter media 58 between the upstream and downstream ends of the casing, into the perforated pipes 54 and then through second shut-off valve 30b as filtered exhaust gas 10b. As indicated above, the operational temperature of the filter 28b is in the range of 100 to 300 degrees Centigrade because this is the temperature of the unfiltered exhaust gas 10a at the filter 28b due to operation of the heat exchanger 22. In this range of temperature, as PM accumulate on the ceramic fiber filter media 58, and UHC tend to condense onto the surface of the PM, thereby coating the PM rather than exiting the filter, as would occur if the operational temperature of the filter were higher. Accordingly, little or no UHC will exit out the exhaust filtration system 20 to the atmosphere.

Considering now the regeneration operation at inactive filter 28a, the glow plug 60 is activated by a source of electricity 60a and the closing of a switch 60b via a signal sent from the microprocessor 46. The accumulated PM and UHC which are situate on the ceramic fiber filter media 58 will be caused to ignite by the heat of the glow plug. It is desired that regeneration proceed in the desired operational temperature range of 100 to 300 degrees Centigrade, and in order to accomplish this, a catalyst must be introduced to lower the combustion temperature of the PM. The conventional catalyst which may be used is of a class of metallic compounds, containing usually lead, copper or manganese. The catalyst may be introduced into the fuel, the additional combustible matter, the unfiltered exhaust gas 10a upstream of the filters 28a, 28b (preferably only the inactive filter during its regeneration), or into the ceramic filter fiber media itself. Once ignition is initiated by the glow plug, a combustion front 62 will fan outwardly across the ceramic fiber filter media over a slow burn period on the order of 10 to 20 minutes. The combustion of the PM and UHC requires oxygen to proceed. This is provided by the microprocessor 46 opening intake valve 36a sufficiently to ensure an adequate amount of air 64 within the inactive filter 28a; an external blower (not shown) may provide additional air flow into the filter. With second shut-off valve 30a closed, the by-products of the regeneration burn in the form of the released gases 10c are directed out through the conduit valve 40a, along conduit components 38a, 42 and 44 to the air intake 16 of the combustion box 12. By recirculating the regeneration burn by-products 66 back into the combustion box 12, any unburned PM or remaining UHC will be consumed in its combustion chambers. Of course, any yet remaining unburned PM or UHC will be retained at the active filter 28b, and will thereafter be later subjected to a regeneration burn and combustion chamber burn when filter 28b goes through its regeneration.

Figure 5A:
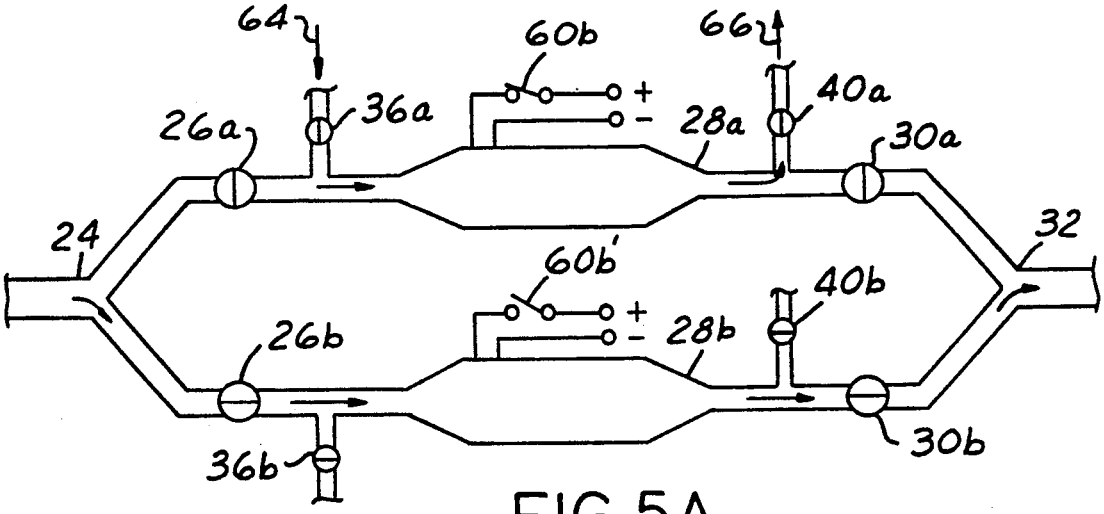
FIGS. 5A and 5B depict part sectional side views of the combustion box exhaust filter system according to the present invention as generally depicted in FIG. 2, alternatively showing gas routing for each filter depending on respective active and inactive status.
Figure 5B:
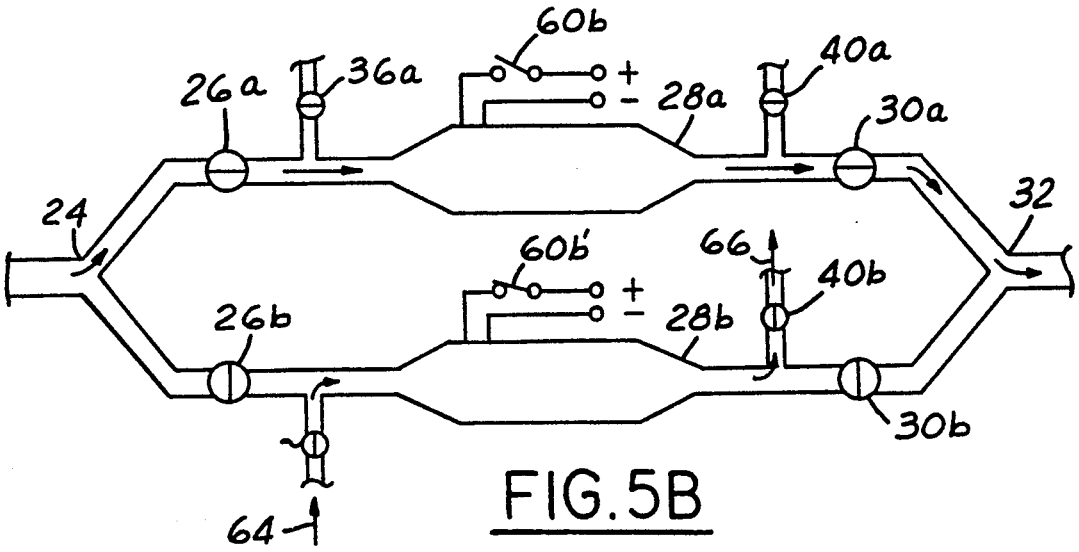

Turning now to FIGS. 5A and 5B, the method of providing a continuous combustion box exhaust filtration process where no PM or UHC are emitted to the atmosphere will be explained, where FIG. 5A depicts the situation as described above relative to FIGS. 1 and 2. Processes at FIGS. 5A and 5B will be considered consecutively.

Regarding inactive filter 28a, the microprocessor 46 has closed both first and second shut-off valves 26a and 30a in order to isolate the inactive filter from the exhaust gases 10a and 10b. Further, the microprocessor opens intake valve 36a and conduit valve 40a. Thereupon, regeneration is initiated by the microprocessor closing switch 60b thereby heating glow plug 60 (not shown in FIG. 5A). Regeneration commences as the PM and UHC ignite adjacent the glow plug, and slowly a combustion front fans out to spread across the entire ceramic fiber filter media of the inactive filter. The microprocessor senses the presence of the progressive oxidation burn and opens switch 60b, thereby turning off the glow plug, which is no longer needed. The regeneration oxidation process is assisted by air entry via the intake valve 36a and the by-products of regeneration in the form of released gases 10c are directed via the conduits associated with conduit valve 40a back to the combustion box 12 at the air intake 16. Because regeneration occurs at a low temperature of preferably between 100 and 300 degrees Celcius due to the presence of the catalyst, the burn rate is slow. Accordingly, the by-products of the regeneration burn may be recycled back into the combustion box air intake without adversely affecting combustion performance in the combustion box 12. By recirculating the regeneration by-products into the air intake 16, any remaining unburned PM and remaining UHC will be combusted in the combustion box 12, and, if any yet remain thereafter, these will be subsequently trapped in the active filter 28b so that virtually no PM or UHC will exit to the atmosphere. When the microprocessor senses that regeneration has completed, it closes the intake valve 36a and conduit valve 40a.

Regarding active filter 28b, the microprocessor 46 has opened first and second shut-off valves 26b and 30b, while intake valve 36b and conduit valve 40b remain closed. Unfiltered exhaust gas 10a passes through the active filter by being forced through the ceramic fiber filter media where the PM and UHC accumulate. Filtered exhaust gas 10b now passes through the perforated pipe and out the exhaust filtration system 20 to the atmosphere. In time the ceramic fiber filter media will become progressively more clogged with PM and UHC. Eventually, back pressure will build to the point that combustion performance will suffer within the combustion box 12. The microprocessor 46 senses this back pressure upstream of active filter 28b.

When a preset value of back pressure is reached, the microprocessor takes the active filter 28b out of duty and places the inactive filter 28a into duty. The microprocessor opens first and second shut-off valves 26a and 30a, while intake valve 36a and conduit valve 40a remain closed. Now filter 28a is the active filter, as depicted in FIG. 5B. Thereafter, the microprocessor closes first and second shut-off valves 26b and 30b, opens intake valve 36b and opens conduit valve 40b. Now, filter 28b is the inactive fitter, as depicted in FIG. 5B. Thereupon the microprocessor closes switch 60b', thereby effecting the glow plug of filter 28b to heat and initiate a regeneration combustion front of the PM and UHC in the ceramic fiber filter media of filter 28b. Once the microprocessor senses the self-sustained combustion front, it opens the switch 60b' to thereby turn off the glow plug. Regeneration is assisted by air which is introduced via intake valve 36b and the by-products of the regeneration process in the form of released gases 10c are directed via conduit valve 40b and its associated conduits to the air intake 16 of the combustion box 12 in the manner aforesaid. When the microprocessor senses that regeneration of filter 28b is completed, it will cause intake valve 36b and conduit valve 40b to close.

The microprocessor will sense back pressure upstream of filter 28a, and when the preset value of back pressure is reached the operations of the filters will reverse back to that depicted in FIG. 5A, in the manner hereinabove generally described. Thus and thereby, continual filtration is accomplished, with periodic regeneration effected, and virtually no PM or UHC ever entering into the atmosphere. Further, by the use of recirculation back to the air intake during regeneration, nitrous oxide emissions will be notably reduced, as the compounds responsible therefor that have been trapped at the ceramic fiber filter media will have been exposed to combustion during regeneration and again in the combustion chambers of the combustion box 12.

Further according to the present invention, when a catalyst containing metallic compounds of copper is added to the fuel, there is a tendency for the fuel to degrade undesirably. In order to provide a copper based catalyst for the low temperature regeneration process, yet ensure stability of the fuel, it has been found that the addition of ethyl alcohol or methyl alcohol in the concentration of 3 to 10 percent by volume of fuel will stabilize the fuel and prevent its degradation.

To those skilled in the art to which this invention appertains, the above described preferred embodiment may be subject to change or modification. For instance, both filters could be actively filtering simultaneously during at least some portion of the normal duty time of one of them. Also, rather than routing by conduit the released gases of regeneration of the inactive filter to the air intake of the combustion box, the released gases could be introduced by conduit into the unfiltered exhaust gas 10a upstream of the active filter. Such change or modification can be carried out without departing from the scope of the invention, which is intended to be limited only by the scope of the appended claims.

What is claimed is:

1. A filtration system for removing particulate matter and unburned hydrocarbons from exhaust gas of a combustion box, said filtration system being connected with an exhaust system of the combustion box, the combustion box having an air intake for aspiration, said filtration system comprising:

a first filter connected with the exhaust system, said first filter being structured so as to trap particulate matter from the exhaust gas;

a second filter connected with the exhaust system, said second filter being structured so as to trap particulate matter from the exhaust gas;

first valve means connected with the exhaust system for selecting at least one of said first and second filters for filtering said exhaust gas;

exhaust gas cooling means connected with said exhaust system upstream of said first and second filter means for providing a predetermined exhaust gas temperature at said first and second filters whereat said unburned hydrocarbons will condense out of said exhaust gas, raid condensed unburned hydrocarbons at least in part condensing onto said trapped particulate matter;

ignition means connected with said first and second filters for selectively initiating regeneration of said first and second filters;

catalytic law temperature regeneration means present at each of said first and second filters during the respective regeneration thereof, said catalytic low temperature regeneration means providing for combustion of said particulate matter and said unburned hydrocarbons at a predetermined rate;

second valve means connected with said first and second filter means for selectively admitting air into one of said first and second filters when said one of said first and second filters is being regenerated;

conduit means for routing combustion gases produced by said combustion in any of said first and second filters to the air intake of the combustion box said predetermined rate of combustion producing said combustion gases at a rate which does not adversely affect combustion performance of the combustion box; and third valve means connected with said conduit means for selectively routing said gases produced by combustion in any of said first and second filters to the air intake of the combustion box.

2. The filtration system of claim 1, further comprising microprocessor means for controlling each of said first, second and third valve means, and for controlling said ignition means so as to optimize filtering performance of said first and second filters.

3. The filtration system of claim 2, wherein said predetermined exhaust gas temperature at said first and second filters is substantially between 100 and 300 degrees Centigrade.

4. The filtration system of claim 3, wherein said catalytic low temperature regeneration means provides a combustion temperature of substantially between 100 and 300 degrees Centigrade, thereby providing Bald predetermined combustion rate.

5. The filtration system of claim 4, wherein said exhaust gas cooling means is a heat exchanger.

6. A method for filtering particulate matter and unburned hydrocarbons from exhaust gas of a combustion box, the combustion box having an air intake for aspiration, the combustion box having an exhaust system connected thereto, the method comprising the steps of:

a) filtering at a first location the exhaust gas by trapping particulate matter and by accumulating unburned hydrocarbons until a predetermined amount of particulate matter has been trapped;

b) after a first predetermined event has occurred, filtering at a second location the exhaust gas by trapping said particulate matter and accumulating said unburned hydrocarbons until said predetermined amount of particulate matter has been trapped at said second location;

c) combusting said trapped particulate matter and said accumulated unburned hydrocarbons at said first location;

d) filtering at said second location the combusted particulate matter and the combusted accumulated unburned hydrocarbons of said first location;

e) after a second predetermined event has occurred, filtering at said first location the exhaust gas by trapping said particulate matter and accumulating said unburned hydrocarbons until said predetermined amount of particulate matter has been trapped at said second location; matter and said f) combusting said trapped particulate matter and said accumulated unburned hydrocarbons at said second location;

g) filtering at said first location the combusted particulate matter and the combusted accumulated unburned hydrocarbons of said second location; and h) repeating the aforesaid steps as needed so as to continuously filter the exhaust gas.

7. The method of claim 6, further comprising the step of pre-cooling the exhaust gas before each said step of filtering to a temperature at said first and second locations in which said unburned hydrocarbons will condense onto said trapped particulate matter.

8. The method of claim 7, wherein said step of precooling reduces the exhaust gas temperature to substantially between 100 and 300 degrees Centigrade at said first and second locations.

9. The method of claim 7, wherein said steps d) and g) further comprise directing said combusted particulate matter and said combusted unburned hydrocarbons to the air intake of the combustion box.

10. The method of claim 9, wherein said steps d) and g) comprise said combustion occurring at a predetermined rate so that said combusted particulate matter and said combusted unburned hydrocarbons can be introduced into said air intake without adversely affecting combustion performance of the combustion box.

11. The method of claim 10, wherein raid steps c) and f) further comprise selective ignition of combustion of said particulate matter and said unburned hydrocarbons.

12. The method of claim 10, wherein said steps c) and f) further comprise selectively introducing air into said first and second locations respectively in order to facilitate said steps of combusting.

13. The method of claim 12, further comprising the step of providing a catalyst at said first and second locations during respective said steps of combusting so that said predetermined rate of combustion occurs.

14. The method of claim 13, wherein said first predetermined event is the attainment of a predetermined amount of particulate matter trapped at said second location; further wherein said second predetermined event is the attainment of a predetermined amount of particulate matter trapped at said first location.

15. The method of claim 13, wherein said first predetermined event is the completion of said steps f) and g); further wherein said second predetermined event is the completion of said steps c) and d).

* * * * *